US005478053A

United States Patent [19]

Richter et al.

[11] Patent Number: 5,478,053

[45] Date of Patent: Dec. 26, 1995

[54] REFRACTORY GAS PURGING DEVICE

[75] Inventors: Tomas Richter, State College; John E. Shoff, Osceola Mills, both of Pa.; John Skok, Amherst, Ohio

[73] Assignee: North American Refractories Co. Inc., Cleveland, Ohio

[21] Appl. No.: 419,449

[22] Filed: Apr. 10, 1995

[51] Int. Cl.[6] ..... C22B 9/05

[52] U.S. Cl. ..... 266/89; 266/220; 266/270

[58] Field of Search ..... 266/99, 78, 220, 266/217, 267, 270, 89

[56] References Cited

U.S. PATENT DOCUMENTS

| | | | |
|---|---|---|---|
| 3,373,986 | 3/1968 | Spire | 266/220 |
| 4,385,752 | 5/1983 | Hayashi | 266/265 |
| 4,396,179 | 8/1983 | Labate | 266/220 |
| 4,481,809 | 11/1984 | LaBate | 73/86 |
| 4,711,432 | 12/1987 | Heinz et al. | 266/220 |
| 4,725,047 | 2/1988 | LaBate | 266/220 |
| 4,741,515 | 5/1988 | Sharma et al. | 266/266 |
| 4,749,172 | 6/1988 | Detalle et al. | 266/99 |
| 4,779,849 | 10/1988 | Rothfuss et al. | 266/270 |
| 4,899,992 | 2/1990 | Thrower et al. | 266/220 |
| 4,905,971 | 3/1990 | Rothfuss et al. | 266/266 |
| 4,944,496 | 7/1990 | Thrower et al. | 266/220 |
| 4,971,295 | 11/1990 | Rothfuss et al. | 266/220 |
| 5,007,366 | 4/1991 | Handler | 116/208 |
| 5,202,079 | 4/1993 | Winkelmann et al. | 266/220 |
| 5,249,778 | 10/1993 | Steichert et al. | 266/99 |

FOREIGN PATENT DOCUMENTS

| | | |
|---|---|---|
| 3246937A1 | 7/1983 | Germany . |
| 3142989C2 | 11/1983 | Germany . |

*Primary Examiner*—Scott Kastler

*Attorney, Agent, or Firm*—Benesch, Friedlander, Coplan & Aronoff

[57] ABSTRACT

This invention relates a refractory gas purging device for the introduction of gases through a metallurgical vessel to molten metal therein, the device having improved wear indication, safety, and performance. In particular, the refractory gas purging device has a porous refractory inner wear indicator which indicates the end of the useful life of the device. Further, the refractory gas purging device has directional gas passages which do not extend throughout the entire length of the device to prevent molten metal leaks from the metallurgical vessel and such directional gas passages being designed to improve the performance of the device.

12 Claims, 2 Drawing Sheets

REFRACTORY GAS PURGING DEVICE

FIELD OF THE INVENTION

This invention relates a refractory gas purging device for the introduction of gases through a metallurgical vessel to molten metal therein, the device having improved wear indication, safety, and performance. In particular, the refractory gas purging device has a porous refractory inner wear indicator which indicates the end of the useful life of the device. Further, the refractory gas purging device has directional gas passages which do not extend throughout the entire length of the device to prevent molten metal leaks from the metallurgical vessel and such directional gas passages being designed to improve the performance of the device.

BACKGROUND OF THE INVENTION

The making of steel or other metals typically involves the introduction of gases into the vessel holding the molten metal. The gas is typically introduced into the vessel via a refractory gas purging device also known as purging cones, porous plugs, or gas purging elements. The refractory gas purging device may be mounted in the bottom or side of the vessel. Prior art refractory gas purging devices fall into two main categories.

The first category comprises conical shaped members or plugs formed of a porous refractory member through which the purging gas is passed. The plug utilizes the porosity of the material for carrying the gas through the device. The porosity is a result of the proper mix design and the proper heat exposure of the refractory mass during the manufacture of the refractory component of the cone. The typical diameters of the pores through which the gas passes are between 0.01 mm to 0.08 mm, which is small enough to prevent the infiltration of molten metal through the plug. These gas purging devices offer a high degree of operational safety, however, the porous refractory material has a limiting effect on the wear resistance of the gas purging device.

The second category comprises directional porosity plugs made from dense refractory materials with formed gas directional channels. Such designs are disclosed in U.S. Pat. No. 4,905,971 and DE-OS 32 46 937. The gas channels are created in-situ, with use of fluidizing material or with embedded hollow tubes. The channels can also be mechanically formed on the outside surface of an internal ceramic element or the inside surface of an external ceramic element. The channels also can be designed as a gap between an external metal can surrounding the plug and the internal dense refractory material. The profiles of the channels, which are also called directional porosity, can be in the form of capillaries, capillary networks, gaps, and slits. The directional porosity extends throughout the entire length of the cone. These directional porosity plugs, in which the dimensions of the gas passages are a magnitude larger than those of the permeable plugs in the first category, offer relatively low operational safety. The liquid metal can easily infiltrate the gas channels eventually causing the plug to act as a sink causing leaks of molten metal from the vessel.

There have been improvements to refractory gas purging devices concerning safety and wear indication. U.S. Pat. No. 4,396,179 and 4,725,047 disclose a device for introducing gas into molten metal having external safety elements to prevent the leakage of molten metal through the device. The disadvantage of these devices is the high cost of manufacturing the device.

U.S. Pat. No. 5,202,079 and German DE-PS 31 42 989 disclose gas purging devices having internal optical wear indicators. The optical wear indicators warn the end of the useful life of the device by changes in the emissivities of the refractory components, or by the change of the shape of the gas passages through the device. The disadvantages are that the wear indication can only be detected during the examination of the empty metallurgical vessel and the shape change of the wear indicator in directional porosity plugs is difficult to recognize during the inspection.

It is desirable to have a refractory gas purging device which has improved safety, wear indication, and performance and which do not suffer from the problems of the refractory gas purging device of the prior art.

SUMMARY OF THE INVENTION

In accordance with the present invention there is provided a refractory gas purging device for introducing gases through a metallurgical vessel to molten metal therein, having improved safety, wear indication, and performance.

Further in accordance there is provided a refractory gas purging device which has a porous refractory inner wear indicator which indicates the end of the useful life of the device.

Still further in accordance with the present invention there is provided a refractory gas purging device having directional gas passages which do not extend throughout the entire length of the device to prevent molten metal leaks from the metallurgical vessel and such directional gas passages being designed to improve the performance of the device.

Still further in accordance with the present invention there is provided a refractory gas purging device for introducing gases through a metallurgical vessel to molten metal therein, said device comprising:

a) an upper end surface in contact with the molten metal within the metallurgical vessel;

b) a lower end surface positioned inwardly to an outside shell of the metallurgical vessel;

c) a metal jacket extending between the upper end surface and the lower end surface;

d) an impervious outer sleeve located within the metal jacket and extending between the upper end surface and the lower end surface;

e) an impervious internal refractory element located within the outer sleeve, the internal refractory element positioned in the upper portion of the outer sleeve;

f) a porous refractory inner wear indicator located within the outer sleeve, the porous inner wear indicator positioned beneath the impervious internal refractory element;

g) directional gas passages located around the internal refractory element extending between the upper end surface and the porous refractory inner wear indicator;

h) gas inlet means for supplying gas from a gas supply to the jacket such that gas flows from the lower end surface through the porous refractory inner wear indicator into the directional gas passages to exit the upper end surface into the molten metal; and i) means for detecting the consumption of the gas purging device and the directional gas passages, the detecting means comprising the porous refractory inner wear indicator having a gas permeability greater than that of the directional gas passages such that upon the consumption of the directional gas passages the flow of gas will increase suddenly accompanied by a sudden change in gas pressure.

These and other aspects of the present invention will be apparent to those skilled in the art upon reading and understanding of the specification that follows.

DETAILED DESCRIPTION OF THE PREFERRED EMBODIMENTS

Figure 1:
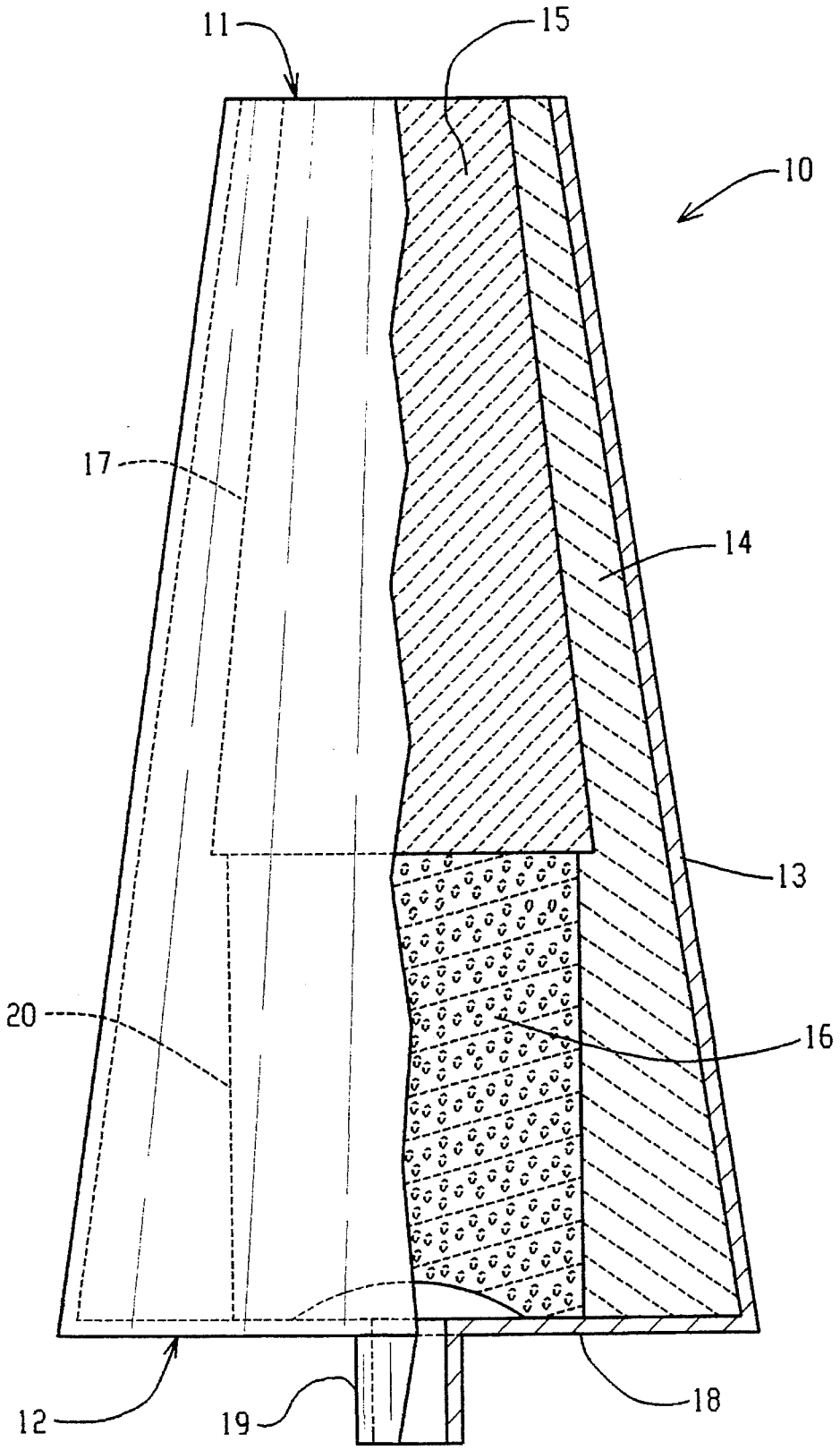
FIG. 1 is a cross-section of the refractory gas purging device according to the present invention showing the various elements making up the gas purging device in accordance with the present invention.

Referring now to the drawings, wherein the showings are for the purposes of illustrating the preferred embodiments of the invention only and not for the purposes of limiting the scope of the claims, FIG. 1 shows a cross-section and the general structure of the refractory gas purging device of the present invention. The gas purging device 10 basically comprises an upper end surface 11 in contact with the molten metal within the metallurgical vessel and a lower end surface 12 adjacent to an outside shell of the metallurgical vessel. A metal jacket 13 extends between the upper end surface 11 and the lower end surface 12. An impervious outer sleeve 14 is located within the metal jacket 13 and extending between the upper end surface 11 and the lower end surface 12. The gas purging device further includes an impervious internal refractory element 15 located within the outer sleeve, the internal refractory element being positioned in the upper portion of the outer sleeve. A porous refractory inner wear indicator 16 is located beneath the impervious internal refractory element in the outer sleeve 14. The gas purging device has directional gas passages 17 located around the internal refractory element 15 extending between the upper end surface 11 and the porous inner wear indicator 16. The device further comprises a base plate 18 and pipe assembly 19 for supplying gas from a gas supply to the jacket such that gas flows from the lower end surface 12 through the porous refractory inner wear indicator 16 into the directional gas passages 17 to exit the upper end surface 11 into the molten metal.

The device is adapted to be inserted, in a known manner, in a metallurgical vessel or an auxiliary device connected thereto. Such vessel and device are not illustrated herein, as they are conventional, and it is contemplated that the concept of the present invention is employable in any such known manner. During use of a metallurgical vessel the device will be progressively worn away in a direction from the upper end surface toward the lower end surface.

The outside metal can 13 is formed of suitable material, such as stainless steel, mild steel, or sheet metal, and has a generally upwardly converging tapered or conical configuration. The outside metal can includes a planar bottom wall which comprises the base plate 18 and pipe assembly 19 into which the purging gas may be introduced into the device.

The impervious outer sleeve 14 is formed of any refractory material, e.g., it is a dense, non-permeable ceramic material, and is shaped to closely fit within the interior of the outside metal can 13. The outer sleeve extends between the upper end surface of the device and the lower end surface.

The impervious internal refractory element 15 is further formed of any refractory material, e.g., any dense, non-permeable ceramic material, and is shaped to closely fit within the interior of the impervious outer sleeve 14. The internal refractory element is positioned in the upper portion of the impervious sleeve.

The directional gas passages 17 extend between the upper end surface 11 and the porous refractory inner wear indicator 16. Specifically, the directional gas passages should not extend between the upper end surface and the lower end surface. This design restricts the passage of liquid metal throughout the lower end of the device and prevents the device from acting as a sink and eventually causing leaks of molten metal from the metallurgical vessel.

Preferably, the refractory gas purging device comprises a permeable bonding 20 between the directional gas passages and the porous refractory inner wear indicator. This permeably bonding bonds the directional gas passages with the porous refractory inner wear indicator.

Figure 2:
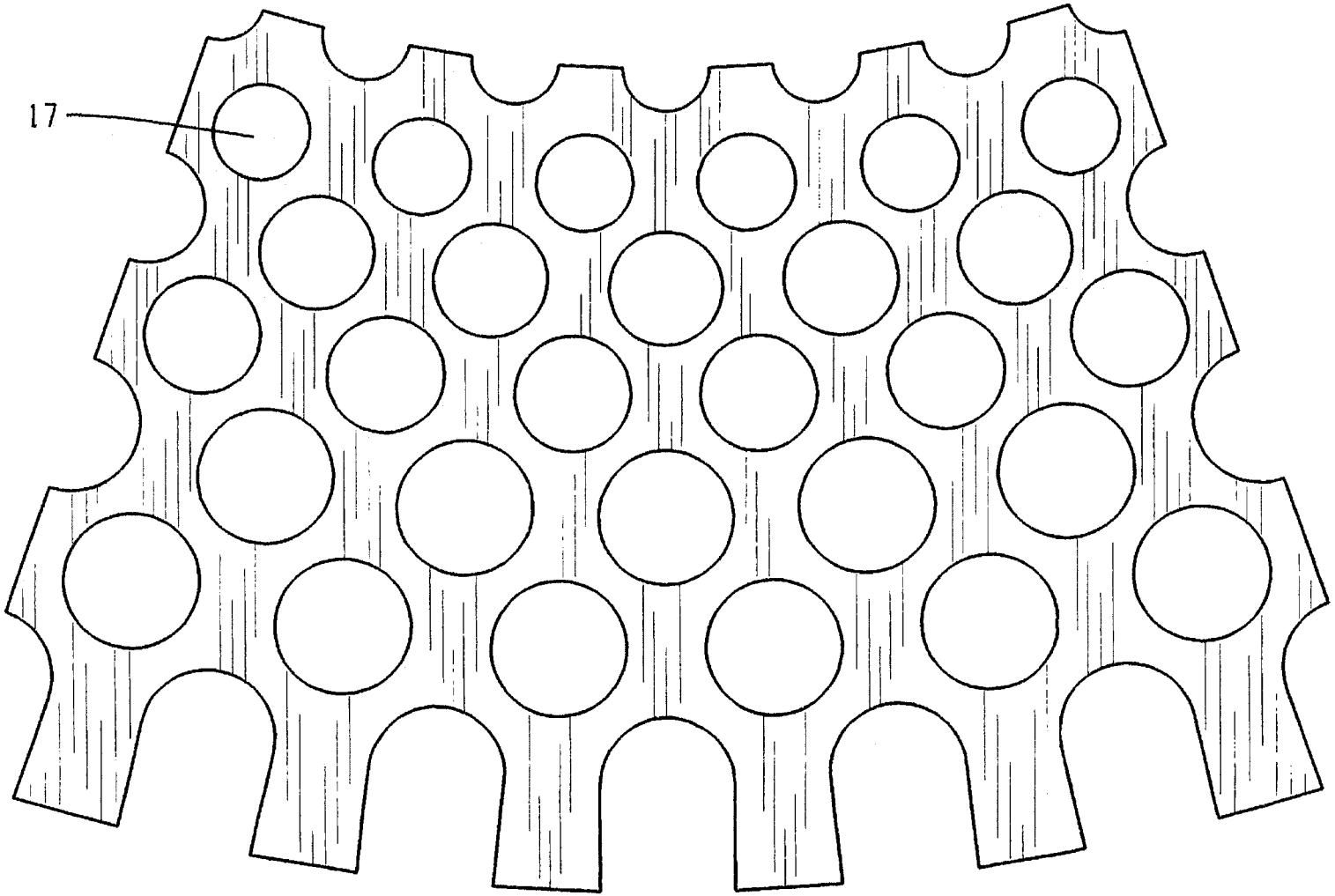
FIG. 2 is a cross-section view of the interconnected slit type directional gas passages.

The directional gas passages can incorporate any type of directional porosity design known in the art. Preferably, the directional gas passages are interconnected slit type directional porosity channels 17 as shown in FIG. 2. The interconnected slit type channels are an improvement over the individual slit channels used in devices of the prior art. Blockage of the individual slits with molten metal usually results in significant reduction in the purging performance of the device. Interconnected slits when partially blocked by molten metal can be easily by-passed, thus reducing the gas flow losses to a minimum. Furthermore, the design of plugs with individual slits wherein the slits are vertically parallel and perpendicular to the upper and lower end surfaces, inherently generates major stress points during heat exposure, fracturing the refractory portion of the plug. The cracks, which are usually generated in the direction of the slit, disturb the integrity of the plug and consequently the purging performance of the device. The interconnected slits used in the gas purging device of the present invention distribute the stresses more evenly, thus reducing the destructive fractures and improving the performance of the device.

The interconnected slits used in the gas purging device are also advantageous over directional capillaries, or capillary networks as the interconnected slits have the ability to transport larger volumes of gases. Directional capillaries can be designed to carry larger volumes of gas by multiplying the layers of capillaries but this significantly increases the manufacturing cost of the gas purging device.

Preferably the direction of the interconnected slits is parallel to the conical sides of the device and not perpendicular to the upper and lower end surfaces. This geometry alters the directions of the compressive forces between the refractory elements and decreases the stress generation in the device.

Preferably, the interconnected slits are designed to have constant or decreasing cross sectional flow area from the upper end surface of the device to the permeable bonding with the porous refractory wear indicator. This design allows for constant flow performance as the device is wearing away.

The porous refractory inner wear indicator 16 is formed of any suitable permeable porous refractory material and is positioned in the impervious outer sleeve 14 beneath the impervious internal refractory element 15. The porous refractory inner wear indicator has open, interconnected porosity. Preferably the diameter of the pores through which the gas passes are between about 0.01 mm and about 0.08 mm. In a preferred embodiment, the diameter of the pores is less than about 0.05 mm.

The porous refractory inner wear indicator has a permeability exceeding the permeability of the directional gas passages. Preferably, the porous refractory inner wear indicator has a permeability at least 25% greater than the permeability of the directional gas passages. Preferably, the directional gas passages have a uniform permeability from the upper end surface to the permeable bonding. The permeability of the permeable bonding is equal to or greater than the permeability of the porous refractory inner wear indicator.

At the end of the useful life of the device, when the internal refractory element and the directional gas passages have been worn away to reach the upper surface of the porous refractory inner wear indicator, the amount of gas flow will suddenly increase since the amount of gas flow is now limited by the porous refractory inner wear indicator which has a significantly higher permeability than the directional gas passages. This immediate rise in gas flow is accompanied with a sudden change in gas pressure.

The various embodiments of the refractory gas purging device for introducing gases through a metallurgical vessel to molten metal therein of the present invention has improved safety, wear indication, and performance. Other features and aspects of this invention will be appreciated by those skilled in the art upon reading and comprehending this disclosure. Such features aspects, and expected variations and modifications of the reported results and examples are clearly within the scope of the invention where the invention is limited solely by the scope of the following claims.

What is claimed is:

1. A frustoconically shaped refractory gas purging device for introducing gases through a metallurgical vessel to molten metal therein, said device comprising a) an upper end surface in contact with the molten metal within the metallurgical vessel;

b) a lower end surface positioned inwardly to an outside shell of the metallurgical vessel;

c) a metal jacket extending between said upper end surface and said lower end surface;

d) an impervious outer sleeve located within said metal jacket and extending between said upper end surface and said lower end surface;

e) an impervious internal refractory element located within said outer sleeve, said internal refractory element positioned in the upper portion of said outer sleeve;

f) a porous refractory inner wear indicator located within said outer sleeve, said porous refractory inner wear indicator positioned beneath said impervious internal refractory element;

g) directional gas passages located around said internal refractory element extending from said upper end surface and into said porous refractory inner wear indicator;

h) gas inlet means for supplying gas from a gas supply to said jacket such that gas flows from said lower end surface through said porous refractory inner wear indicator into said directional gas passages to exit said upper end surface into the molten metal; and i) means for detecting the consumption of said gas purging device and said directional gas passages, said detecting means comprising said porous refractory inner wear indicator having a gas permeability greater than that of said directional gas passages such that upon the consumption of said directional gas passages the flow of gas will increase suddenly accompanied by a sudden change in gas pressure.

2. The refractory gas purging device of claim 1 wherein said directional gas passages do not extend through said porous refractory inner wear indicator to said lower end surface.

3. The refractory gas purging device of claim 1 further comprising a permeable bonding between said porous refractory inner wear indicator and said directional gas passages, said permeable bonding connecting said porous refractory inner wear indicator to said directional gas passages.

4. The refractory gas purging device of claim 3 wherein said directional gas passages do not extend through said porous refractory inner wear indicator to said lower end surface.

5. The refractory gas purging device of claim 1 wherein said porous refractory inner wear indicator comprises pores having diameters of up to 0.1 mm.

6. The refractory gas purging device claim 5 wherein said porous refractory inner wear indicator comprises pores having diameters of 0.01 mm to 0.05 mm.

7. The refractory gas purging device of claim 1 wherein said porous refractory inner wear indicator has a permeability at least 25% greater than the permeability of said directional gas passages.

8. The refractory gas purging device of claim 1 wherein said directional gas passages are in the shape of interconnected slits.

9. The refractory gas purging device of claim 8 wherein said interconnected slits are in a direction parallel to the conical sides of said device.

10. The refractory gas purging device of claim 8 further comprising a permeable bonding between said porous refractory inner wear indicator and said interconnected slits, said permeable bonding connecting said porous refractory inner wear indicator to said directional gas passages.

11. The refractory gas purging device of claim 10 wherein said interconnected slits have a constant cross sectional flow area which is constant from said upper end surface to said permeable bonding with said porous refractory inner wear indicator.

12. The refractory gas purging device of claim 10 wherein said interconnected slits have a cross sectional flow area which decreases in the direction from said upper end surface to said permeable bonding with said porous refractory inner wear indicator.

* * * * *